US005198274A

United States Patent [19]

Etzion

[11] Patent Number: 5,198,274

[45] Date of Patent: Mar. 30, 1993

[54] TIE ASSEMBLY FOR ORNAMENT

[76] Inventor: Rafael Etzion, 15 Henhawk Rd., Great Neck, N.Y. 11024

[21] Appl. No.: 803,619

[22] Filed: Dec. 9, 1991

[51] Int. Cl.[5] ..... D04D 7/10

[52] U.S. Cl. ..... 428/5; 28/147; 223/46; 428/542.8

[58] Field of Search ..... 428/4, 5, 542.8, 7; 28/147; 223/46; 24/30.5 T

[56] References Cited

U.S. PATENT DOCUMENTS

| | | | |
|---|---|---|---|
| 3,290,854 | 12/1966 | MacMurray | 24/30.5 T X |
| 3,501,364 | 3/1970 | Rowland | 428/5 |
| 3,909,979 | 10/1975 | Perez | 24/30.5 T X |
| 4,529,636 | 7/1985 | Olson | 428/43 X |
| 4,539,237 | 9/1985 | Clayton | 428/43 X |
| 4,915,996 | 4/1990 | Curry | 428/5 X |
| 5,004,144 | 4/1991 | Selga | 428/4 X |
| 5,116,687 | 5/1992 | Asano et al. | 428/5 X |

*Primary Examiner*—Henry F. Epstein
*Attorney, Agent, or Firm*—Robin, Blecker, Daley & Driscoll

[57] ABSTRACT

A tie assembly for use in joining ornament elements to form an ornament. The tie assembly comprises a strip of material whose first and second ends have been folded over and placed in abutting dove-tail relationship. A tie element is joined to and along the length of the first and second ends of the folded strip and has third and fourth ends which extend beyond this length and can be used to fix the tie assembly and the ornament elements together.

16 Claims, 3 Drawing Sheets

TIE ASSEMBLY FOR ORNAMENT

BACKGROUND OF THE INVENTION

This invention relates to ornaments and, in particular, to ornaments having a centrally arranged tie element.

In the formation of ornaments and, in particular, bow-like ornaments, it is customary to form the ornaments from a plurality of elements each of which has a creased central region. The ornament elements of each ornament are abutted together so that the central creased regions are adjacent. An elongated tie element is then wrapped around the adjacent central regions to help hold the ornament elements together and complete the ornament.

In one form of ornament of this type, the tie element is part of a tie assembly which includes a further element which hides the tie element from view and provides a pleasing appearance for the central part of the ornament. This further element comprises a tubular or cylindrical member formed by bringing the ends of a strip of material into overlapping relationship.

The tie element is then affixed to the overlapping ends of the formed cylindrical member interiorly so that it extends beyond the edges of the cylinder. The tie element is attached to the cylinder by stapling or otherwise joining these elements together along the length of the overlapping ends. This serves to also simultaneously join the overlapping ends of the cylinder together.

In use, the aforesaid cylindrical member is placed with its overlapped ends and joined tie element situated against the front faces of the abutting central regions of the ornament elements. The tie ends are then brought to the back face of the ornament elements and joined or twisted together. The tie element and cylindrical member thus become secured to the ornament elements which also become secured together to form the ornament. In this completed form, the cylindrical member appears as an attractive loop providing a overall pleasing appearance to the central part of the ornament.

In forming the aforesaid cylindrical member, the ends of a strip of material are required to be brought into overlapping relationship. The tie element is then required to be joined interiorly to the overlapped ends. These procedures are time consuming and labor intensive. Any simplification of the procedures and/or the tie assembly would, therefore, be beneficial to the ornament manufacturer.

It is therefore an object of the present invention to provide an improved tie assembly and method of making same.

SUMMARY OF THE INVENTION

In accordance with the principles of the present invention, the above and other objectives are realized in a tie assembly in which a strip of material is folded over to situate first and second ends of the material in dove-tail fashion and to thereby define a collapsed cylinder which appears somewhat pear-shaped. A second member in the form of a tie element is then joined to at least one of the first and second ends along its length. The ends of the tie element extend beyond this length for use in later tying the tie element and folded material to the ornament elements being used to form the ornament.

In use, the tie assembly is situated adjacent the abutting central regions of the ornament elements. The dove-tail joined ends of the folded material and the joined tie element are then placed at and around the central regions of the ornament elements. This brings the tie ends into proximity. The ends are then joined, thereby securing the tie assembly and the ornament elements together. The folded material in this position remains in collapsed cylinder form. The cylinder is then shifted laterally, causing it to expand or pop-up and take on a pleasing loop-like appearance to complete formation of the ornament.

In the illustrative embodiment of the invention to be disclosed hereinafter, the tie element is situated or sandwiched between the dove-tail joined ends of the folded material to facilitate connecting these members together. Additionally, the surface of the tie element and the facing surfaces of the dive-tail joined ends comprise a heat fusible material such as plastic and the tie and ends are joined by heating to fuse the members together.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
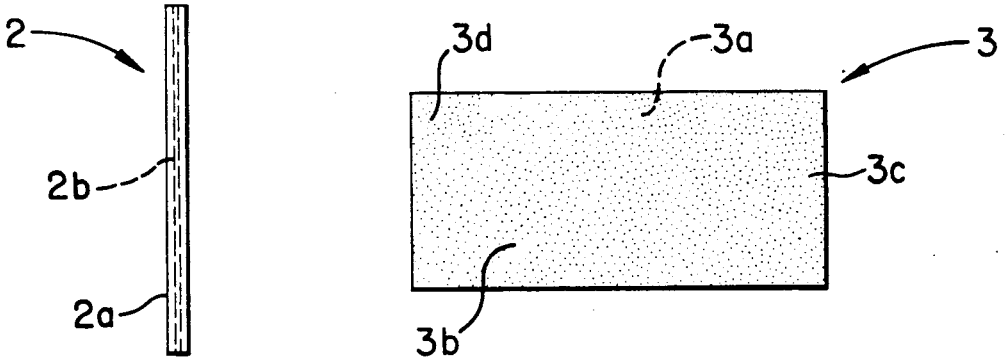
FIG. 1 illustrates the constituent parts in unassembled form of a tie assembly in accordance with the principles of the present invention.

FIG. 1 shows first and second members 2 and 3 which can be used to form a tie assembly 1 (see, FIG. 2) in accordance with the principles of the present invention. The member 2 is in the form of a tie element which, in the case shown, comprises an outer sheath **2*a* which carries interiorly an elongated wire 2*b*. The sheath 2*a*** is preferably made of a plastic or other heat joinable or fusible material.

The second member 3 is in the form of a strip of material which has a decorative face **3*a* formed on a backing 3*b*. The face 3*a* typically might be a felt or other similar type material. The backing 3*b***, in turn, preferably also is made of a plastic or other heat joinable or fusible material.

Figure 2:
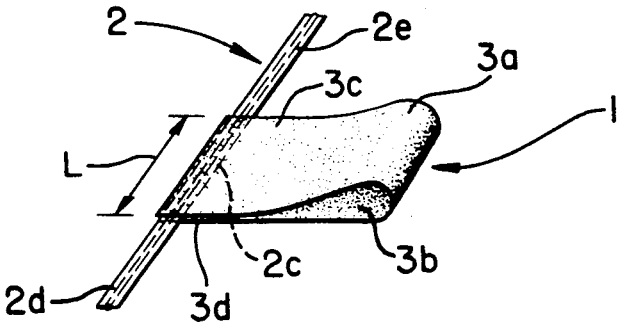
FIG. 2 shows the tie assembly parts of FIG. 1 assembled into a tie assembly in accordance with the principles of the present invention.

FIG. 2 shows the members 2 and 3 formed into a tie assembly 1. As can be seen, the lateral ends **3*c* and 3*d* of the strip of material have been folded over and brought into abutting dove-tail relationship to form a collapsed cylinder which appears somewhat pear-shaped. Interposed between the dove-tail abutting ends 3*c* and 3*d* of the collapsed cylinder is a central section 2*c* of the tie element 2. End sections 2*d* and 2*e* of the tie element, in turn, extend beyond the length L of the dove-tail ends 3*c* and 3*d***.

In the preferred form of the invention, the ends **3*c* and 3*d* of the cylinder and the central section 2*c* of the tie element 2** are affixed or joined to each other by applying heat. This causes fusing of the heat fusible materials forming these parts so that the parts are fixedly joined to each other.

Figure 3:
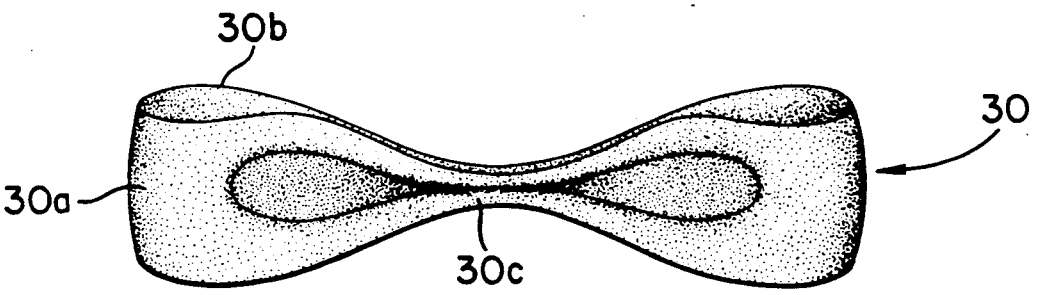
FIG. 3 shows an ornament element for forming an ornament in conjunction with the tie assembly of FIGS. 1 and 2.

FIG. 3 shows an ornament element which can be used to form an ornament in conjunction with tie assembly 1 of the invention. In the case of FIG. 3, the ornament element comprises a flattened loop of material 30 whose facing loop parts 30*a*, 30*b* are jointly double creased in a central region 30*c*. The loop 30 typically might be formed by folding a strip of material having the same decorative facing and plastic backing as that of the strip 3. Additionally, the creases in the central region 30*c* of the element may be held in place by a staple or other type of holding assembly (not shown).

Figure 4:
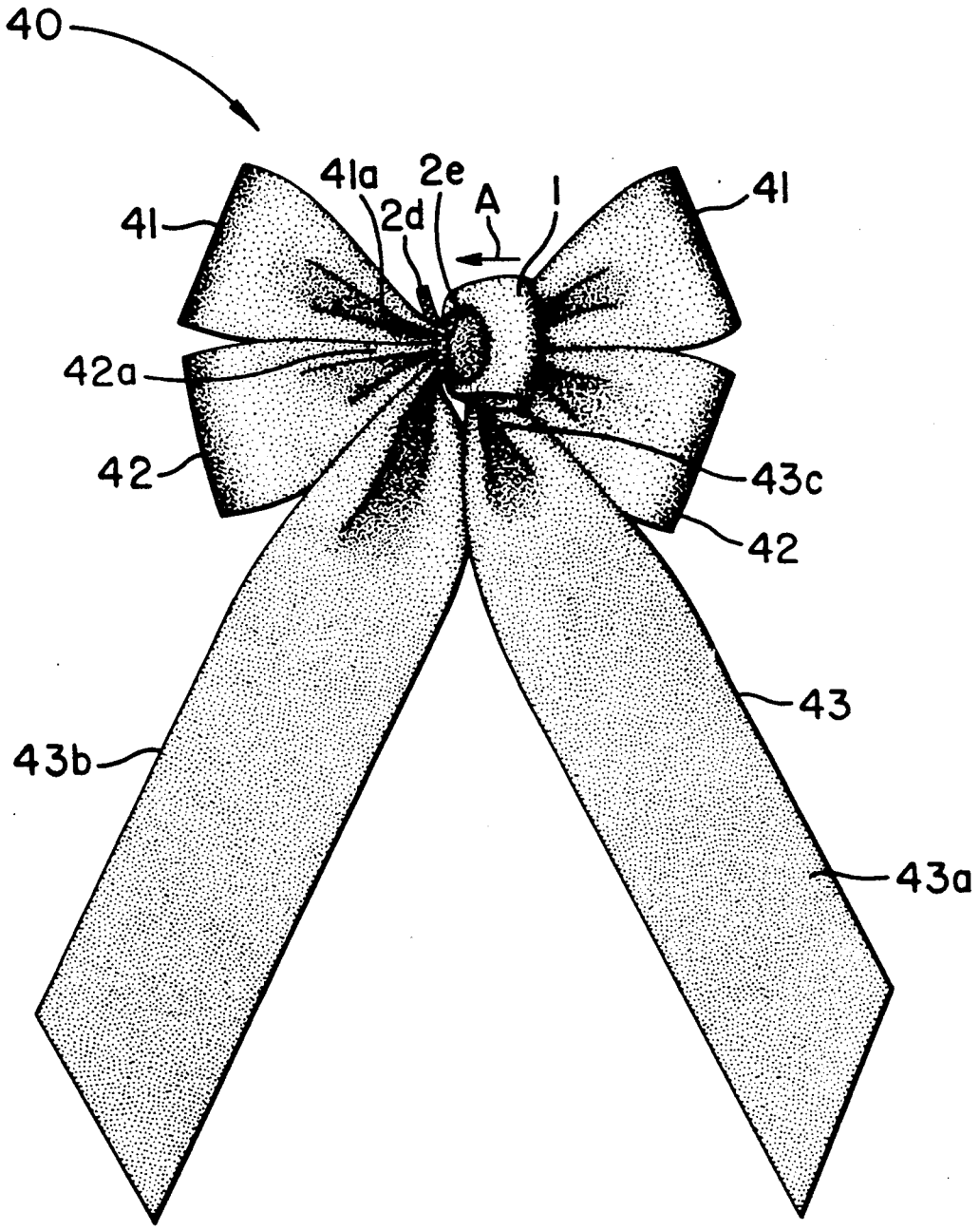
FIG. 4 shows an ornament formed from a number of ornament elements of FIG. 3 and which have been tied by the tie assembly of FIGS. 1 and 2.

FIG. 4 illustrates a number of ornament elements 41, 42 of the type shown in FIG. 3 and a further ornament element 43 organized with the tie assembly 1 to form an ornament 40. The ornament element 43 comprises streamers 43*a* and 43*b* which extend from a central region 43*c* which has also been double creased. To form the ornament 40, the central creased regions 41*a*, 42*a* of the ornament elements 41, 42 and the central creased region 43*c* of the ornament element 43 are placed in abutting relationship. The dove-tail joined ends 3*c* and 3*d* and the joined tie element 2 of the tie assembly 1 are then situated adjacent the abutting central regions of the ornament elements with the remainder of the collapsed cylinder extending laterally. The ends 3*c* and 3*d* and the tie element 2 are then brought around the abutting central regions until the ends 2*d* and 2*e* of the tie 2 are in proximity. The tie ends 2*d* and 2*e* are thereafter joined together as by twisting. This connects the tie assembly and the ornament elements 41–43 together.

Figure 5:
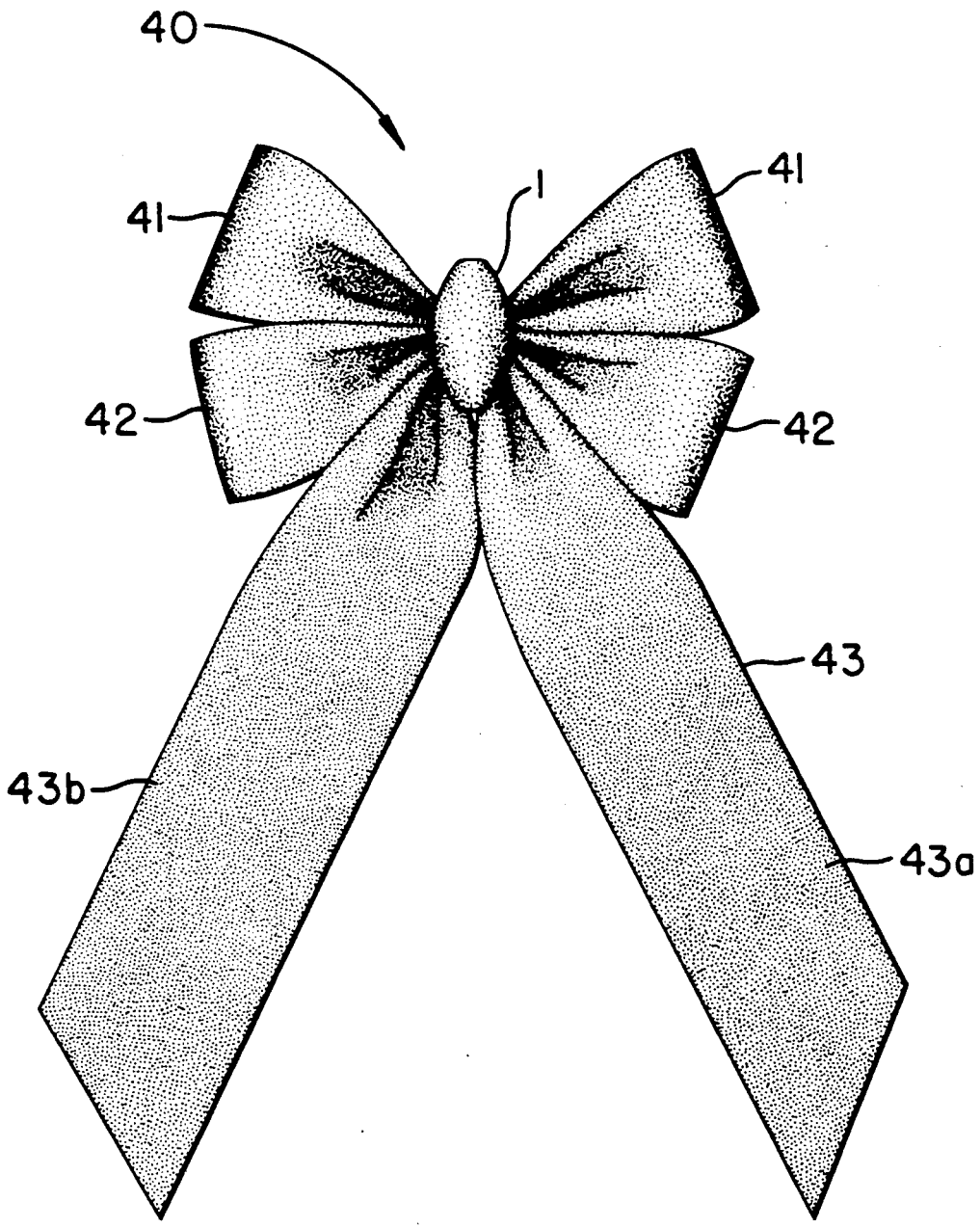
FIG. 5 shows the ornament of FIG. 4 with the tie assembly adjusted to complete the ornament.

In order to finish the ornament, the collapsed cylinder part of the tie assembly is shifted laterally (in the case shown to the left as indicated by arrow A), causing the cylinder to expand or pop-up and remain in this condition. This results in a pleasing loop-like appearance as can be seen from the completed ornament in FIG. 5.

It should be noted that in the tie assembly of FIG. 2, the tie element 2 has been shown as being heat fused to the dove-tail joined ends 3*c* and 3*d* of the folded material 3. However, the tie element 2 can be joined to the ends 3*c* and 3*d* in other ways as by stapling or gluing, for example. Also, the tie element 2 can be joined to the outer surface of either one of the ends 3*c* and 3*d* or to the end surface of these ends.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. A tie assembly for use in conjunction with elongated strips of material defining ornament elements to be formed into a low ornament, the tie assembly comprising:

a strip of material having first and second ends, said strip of material being folded over to place said first and second ends in abutting dove-tail relationship;

a tie element having a central portion joined to and extending along the length of at least one of said first and second ends and having third and fourth ends extending beyond said length.

2. A tie assembly in accordance with claim 1 wherein:

the central portion of said tie element is sandwiched between said first and second ends.

3. A tie assembly in accordance with claim 2 wherein:

the outer surface of said tie element comprises a heat fusible material;

the surfaces of said first and second ends facing said tie element comprise a heat fusible material;

and said tie element is joined to said first and second ends by said outer surface of said tie element being fused to said facing surfaces of said first and second ends.

4. A tie element in accordance with claim 3 wherein:

said strip of material comprises a decorative surface layer on a plastic backing, portions of said plastic backing forming said surfaces of said first and second end facing said tie element;

and said tie element comprises a plastic sheath in which is embedded a wire, said plastic sheath forming said outer surface of said tie element.

5. A method of making a tie assembly for use in conjunction with elongated strips of material defining ornament elements to be formed into a bow-like ornament, the method comprising:

folding a strip of material over to place first and second ends of said material in abutting dove-tail relationship;

and joining the central portion of a tie element to and along the length of at least one of said first and second ends so that third and fourth ends of said tie element extend beyond said length.

6. A method in accordance with claim 5 wherein:

said joining step includes sandwiching the central portion of said tie element between said first and second ends.

7. A method in accordance with claim 6 wherein:

the outer surface of said tie element comprises a heat fusible material;

the surfaces of said first and second ends facing said tie element comprise a heat fusible material;

and said joining step comprises applying heat to said sandwich of said first and second ends and said central portion of said tie element to fuse said outer surface of said tie element to said facing surfaces of said first and second ends.

8. A method in accordance with claim 7 wherein:

said strip of material comprises a decorative surface layer on a plastic backing, portions of said plastic backing forming said surfaces of said first and second ends facing said tie element;

and said tie element comprises a plastic sheath in which is embedded a wire, said plastic sheath forming said outer surface of said tie element.

9. A bow ornament comprising:

a plurality of ornament elements each comprising an elongated strip of material, said ornament elements having central regions arranged in abutting relationship;

a tie assembly comprising: a strip of material having first and second ends, said strip of material being folded over to place said first and second ends in abutting dove-tail relationship; a tie element having a central portion joined to and extending along the length of at least one of said first and second ends and having third and fourth ends extending beyond said length;

said tie assembly being arranged with said joined first and second ends and said tie element extending along and around said abutting central regions of said ornament elements and with said third and fourth ends of said tie element joined to hold said tie assembly and said ornament elements together to form said bow ornament.

10. A bow ornament in accordance with claim 9 wherein:

said folded over strip of material forms a collapsed cylinder which can be shifted laterally when said tie assembly and ornament elements are joined together so as to expand said cylinder.

11. A bow ornament in accordance with claim 9 wherein:

each elongated strip of material of an ornament element is a collapsed loop whose facing loop parts are creased centrally to form said central regions.

12. A bow ornament in accordance with claim 9 wherein:

the central portion of said tie element is sandwiched between said first and second ends.

13. An bow ornament in accordance with claim 12 wherein:

the outer surface of said tie element comprises a heat fusible material;

the surfaces of said first and second lateral ends facing said tie element comprise a heat fusible material;

and said tie element is joined to said first and second ends by said outer surface of said tie element being fused to said facing surfaces of said first and second ends.

14. A bow ornament in accordance with claim 13 wherein:

said strip of material comprises a decorative surface layer on a plastic backing, portions of said plastic backing forming said surfaces of said first and second ends facing said tie element;

and said tie element comprises a plastic sheath in which is embedded a wire, said plastic sheath forming said outer surface of said tie element.

15. A method of forming a bow ornament comprising:

placing the central regions of a plurality of ornament elements in abutting relationships, said ornament elements each comprising an elongated strip of material;

providing a tie assembly comprising: a strip of material having first and second ends, said strip of material being folded over to place said first and second ends in abutting dove-tail relationship; and a tie element having a central portion joined to and extending along the length of at least one of said first and second ends and having third and fourth ends extending beyond said length;

and placing said joined first and second ends and said tie element along and around said abutting central regions of said ornament elements and joining said third and fourth ends of said tie element together to hold said tie assembly and said ornament elements together to form said bow element.

16. A method of forming a bow ornament in accordance with claim 15 wherein:

said folded over strip of material forms a collapsed cylinder;

and said method further comprises shifting said collapsed cylinder laterally after said tie assembly and ornament elements have been joined together so as to expand said cylinder.

* * * * *

UNITED STATES PATENT AND TRADEMARK OFFICE

CERTIFICATE OF CORRECTION

PATENT NO. : 5,198,274

DATED : March 30, 1993

INVENTOR(S) : Rafael Etzion

It is certified that error appears in the above-identified patent and that said Letters Patent is hereby corrected as shown below:

| | |
|---|---|
| Col. 1, line 39 | Change "a" to -- an -- |
| Col. 2, line 14 | Change "dive" to -- dove -- |
| Col. 3, line 59 | Change "low" to -- bow-like -- |
| Col. 4, line 6 | After "second" insert -- lateral -- |
| Col. 4, line 53 | Change "bow" to-bow-like -- |
| Col. 5, lines 4, 5, 11, 16 | Change "bow" to -- bow-like -- |
| Col. 5, line 20 | Change "An bow" to -- A bow-like -- |
| Col. 5, line 31 | Change "bow" to -- bow-like -- |
| Col. 6, lines 6, 25, 26 | Change "bow" to -- bow-like -- |

Signed and Sealed this

Seventh Day of December, 1993

Bruce Lehman

*Attest:*

BRUCE LEHMAN

*Attesting Officer*

*Commissioner of Patents and Trademarks*